US005271620A

United States Patent [19]

Moriguchi et al.

[11] Patent Number: 5,271,620

[45] Date of Patent: Dec. 21, 1993

[54] GOLF CLUB HEAD

[75] Inventors: Kazutomo Moriguchi, Soka; Tsuneo Akatsuka, Saitama; Yoshihiro Motoki, Misato; Takashi Harada, Soka, all of Japan

[73] Assignee: Somar Corporation, Japan

[21] Appl. No.: 966,330

[22] Filed: Oct. 26, 1992

[30] Foreign Application Priority Data

Mar. 25, 1992 [JP] Japan ..... 4-025521[U]

[51] Int. Cl.[5] ..... A63B 53/04

[52] U.S. Cl. ..... 273/167 F; 273/167 H; 273/169

[58] Field of Search ..... 273/167 R-177 A, 273/187.4, 186.2, 77 R, 129 K, 164.1, 162 R; D21/214-220

[56] References Cited

U.S. PATENT DOCUMENTS

D. 229,431 11/1973 Baker ..... 273/167 G
3,845,955 11/1974 Solheim ..... 273/167 A X
3,980,301 9/1976 Smith ..... 273/167 G X
4,147,349 4/1979 Jeghers ..... 273/77 A
4,426,083 1/1984 Dishner ..... 273/164.1
4,632,400 12/1986 Boone ..... 273/164.1

FOREIGN PATENT DOCUMENTS 8801525 3/1988 World Int. Prop. O. ..... 273/167 F

*Primary Examiner*—V. Millin
*Assistant Examiner*—Sebastiano Passaniti
*Attorney, Agent, or Firm*—Lorusso & Loud

[57] ABSTRACT

A golf club head having the center of mass located below the half face height. The club head includes a top surface, a sole disposed opposite to the top surface, a toe portion, a heel portion opposite to the toe portion, a front, impact face located between the toe and heel portions, a rear portion located opposite to the face and between the toe and heel portions. The toe and rear portions together form a smooth, continuous, enlarged side surface so that an upper section of the club head above the horizontal center plane, which passes the half height of the face portion, has a volume smaller than that of a lower section of the club head below the horizontal center plane.

2 Claims, 2 Drawing Sheets

GOLF CLUB HEAD

BACKGROUND OF THE INVENTION

1. Field of the Invention

This invention relates to a golf club head.

2. Description of Prior Art

One known wood club head is shown in FIGS. 5 and 6 of the accompanying drawings. The golf club head includes a crown, top surface 2, a bottom surface or sole 7 disposed opposite to the top surface 2, a toe portion 5, a heel portion 6 opposite to the toe portion 5, a front portion 3 having a flat impact face and located between the toe and heel portions, a rear portion 4 located opposite to the front portion 3 between the toe and heel portions. Each of the toe portion 5, heel portion 6, front portion 3 and rear portion 4 is integral with the top surface 2 and with the bottom surface 7 so that an upper, smooth, continuous ridge 8 is formed between the top surface 2 and toe, heel, front and rear portions and a lower, smooth, continuous ridge 9 is formed between the bottom surface 7 and toe, heel, front and rear portions.

The toe and rear portions 5 and 4 form a smooth, continuous, side surface inwardly inclined at an angle $\theta_1$ relative to the vertical line when viewed on the toe as shown in FIG. 5 and at an angle $\theta_2$ relative to the vertical line on the head-on view of FIG. 6. This structure of the conventional golf club head results in the center of gravity shifted toward the top surface 2. From the standpoint of distance of shot, however, it is desirable that the center of gravity be low. Thus, a weight is mounted in a lower portion of the club head and/or the thickness of the sole is increased to lower the center of gravity.

On the other hand, there is an increasing demand for a wood club head having such a large volume as to provide an increased area of sweet spot. In this respect, the known club head is disadvantageous since an increase in volume results in the upward shift of the center of gravity and since a heavier weight or a thicker wall must be used.

SUMMARY OF THE INVENTION

It is the prime object of the present invention to provide a golf club head structure which has an increased volume without increasing the weight thereof and whose center of gravity is low.

Another object of the present invention is to provide a wood club head having a large sweet spot.

In accomplishing the foregoing objects, the present invention provides a golf club head including a top surface, a sole disposed opposite to the top surface, a toe portion, a heel portion opposite to the toe portion, a front, impact face portion located between the toe and heel portions, a rear portion located opposite to the face portion and between the toe and heel portions, the toe and rear portions forming a smooth, continuous, enlarged side surface so that an upper section of the club head above the horizontal face center plane, which bisects the height of the face portion, has a volume smaller than that of a lower section of the club head below the center plane.

The terms used herein are in accordance with "GOLF CLUB DESIGN, FITTING, ALTERATION AND REPAIR, the principles and procedures" by Ralph Maltby, 2nd edition published in May 1982 by Ralph Maltby Enterprises, Inc., U.S.A. and the following terms mean as follows:

Center of Gravity: center of mass and/or the location where all balance points intersect;

Face: the hitting surface of a wood club;

Vertical Face Center Plane: the vertical plane which includes the sole line;

Half Face Height: a height equal to ½ of the height of the face on the vertical face center plane;

Horizontal Face Center Plane: the horizontal plane at the half face height;

Heel: that portion of a club head where the sole and the hosel meet;

Hosel: that portion of a club head designed to interfit with the shaft;

Loft: the angle of the face relative to a line perpendicular to the sole;

Sole: the bottom surface of a club head that rests on the ground when the club is held in the hitting position. The sole may be flat or slightly concave but is generally cambered;

Sole line: the line on the ground in the direction from front to back at which the cambered sole contacts the ground when the club is rested on its sole in the hitting position;

Toe: that portion of a club head that is farthest away from the hosel;

Wood: a club head, not necessarily made of wood, having a loft angle less than 22°.

BRIEF DESCRIPTION OF THE DRAWINGS

Other objects, features and advantages of the present invention will become apparent from the detailed description of the preferred embodiment of the invention which follows, when considered in the light of the accompanying drawings, in which.

DETAILED DESCRIPTION OF THE PREFERRED EMBODIMENT OF THE INVENTION

Figure 1:
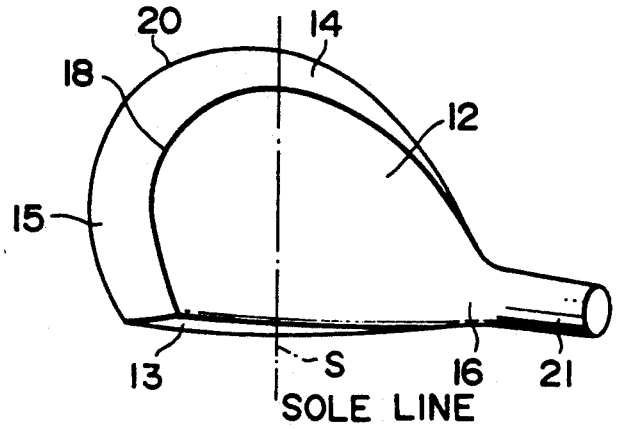
FIG. 1 is a plan view showing one embodiment of wood club head according to the present invention rested on its sole in the designated playing position.

Referring now to FIGS. 1–4, the club head of this invention includes a top surface 12, a sole (bottom surface) 17 disposed opposite to the top surface 12, a toe portion 15, a heel portion 16 opposite to the toe portion, a front, face portion 13 serving as an impact surface and located between the toe and heel portions 15 and 16, a rear portion 14 located opposite to the face portion 13 between the toe and heel portions 15 and 16. The heel portion 16 has a hosel 21 to be connected to a club shaft not shown.

The toe portion 15, heel portion 16, face portion 13 and rear portion 14 are integral with the top surface 12 and with the bottom surface 17 so that upper and lower, smooth, continuous ridges 18 and 19 are formed between the top surface 12 and the toe, heel, front and rear portions and between the bottom surface 17 and the toe, heel, front and rear portions, respectively.

The toe and rear portions 15 and 14 together form a smooth, continuous, enlarged side surface such that an upper section X of the club head above the horizontal center plane C, which passes through the half height of the face portion 13, has a volume smaller than that of a lower section Y of the club head below the center plane C. The volume of the upper section includes that of the hosel 21. Preferably, the volume ratio of the upper section to the lower section is between 30:70 to 45:55.

Figure 2:
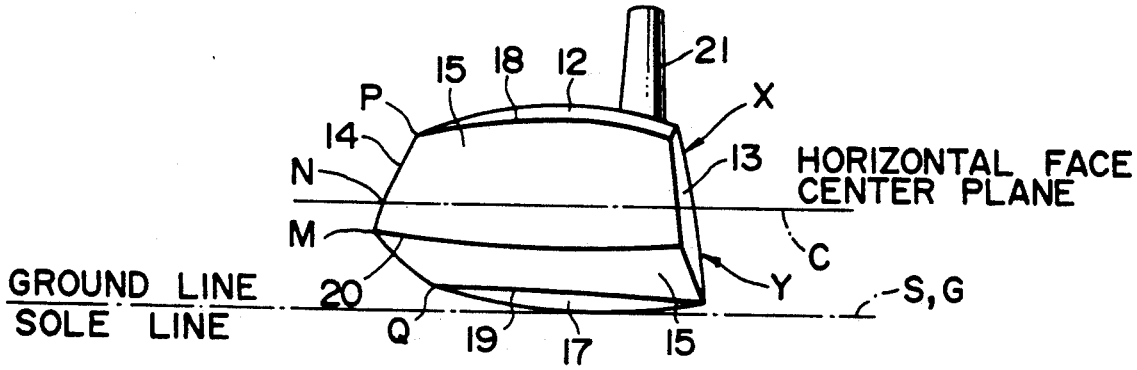
FIG. 2 is a side, toe-on view of the club head of FIG. 1.
Figure 3:
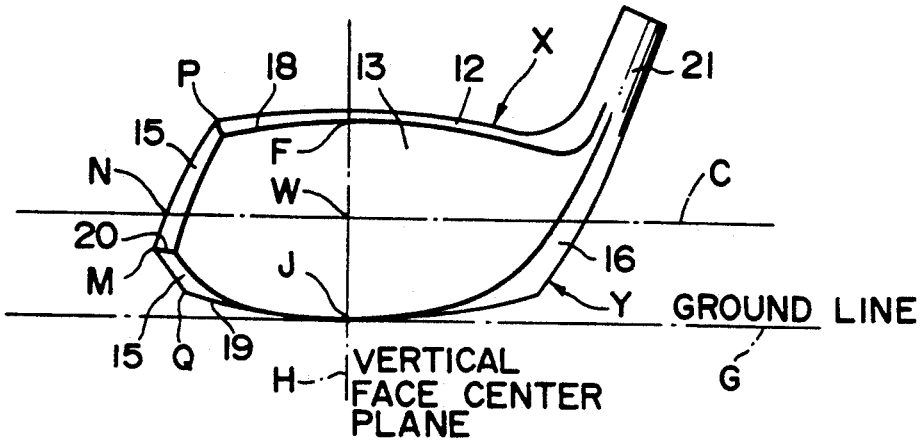
FIG. 3 is a front, face-on view of the club head of FIG. 1.
Figure 4:
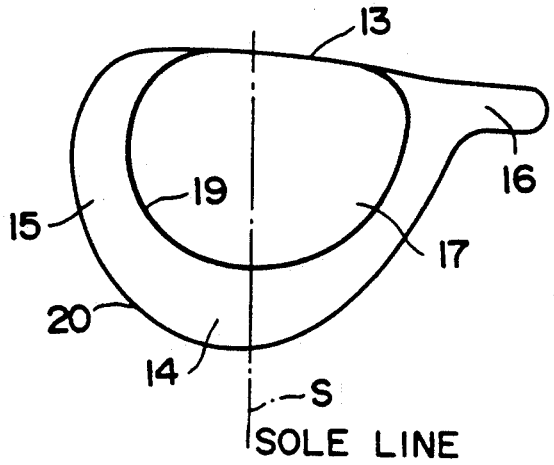
FIG. 4 is a bottom, sole-on view of the club head of FIG. 1.
Figure 5:
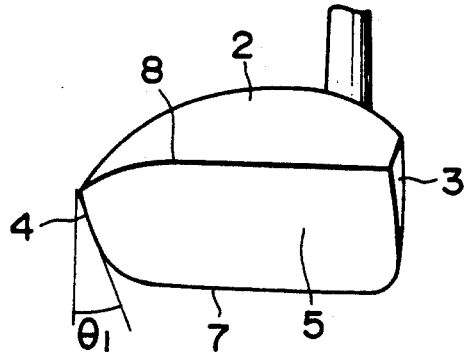
FIG. 5 PRIOR ART
FIG. 5 is a toe-on view, similar to FIG. 2, showing conventional club head.
Figure 6:
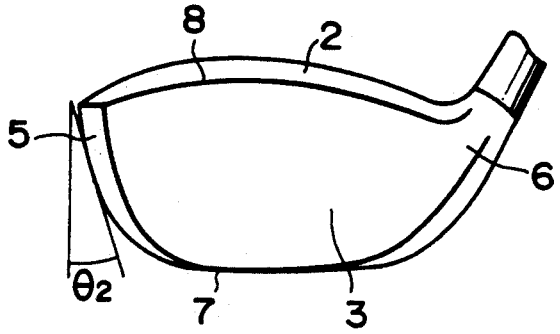
FIG. 6 PRIOR ART
FIG. 6 is a face-on view, similar to FIG. 3, of the club head of FIG. 5.

The center plane C is horizontal when the club is rested on its head in the hitting position as shown in FIGS. 1-3 and passes through a midpoint W (FIG. 3) between points F and J on the upper and lower edges 18 and 19 of the face 13. The distance between the points F and J is referred to as face height and the midpoint W represents half face height. These points F, J and W on the face 13 exist on a vertical, face center plane H on which the sole line S lies. The cambered sole 17 contacts the ground G at the sole line S.

Preferably, the side surface formed by the toe and rear portions 15 and 14 has a maximum enlarged portion 20 located below the center plane C but above the lower ridge 19. Thus, as shown in toe-on view of FIG. 2, the contour of the back portion 14 is a C-shaped line protruding outward in an intermediate portion. The protrusion is maximum at the point M. The point P at which the contour line meets the upper ridge 18 and the point Q at which the contour line meets the lower ridge 19 are located inward (rightward) from the point M. This also applies to the face-on view of FIG. 3 and to any other intermediate view through 90 degree rotation between the toe-on and face-on views. In this case, the point M is always located below the point N at which the contour line crosses the center plane C.

The club head according to the present invention may be formed from a metal shell packed with a suitable packing material such as a polyurethane foam. The wall thickness is, for example, about 3 mm in the front portion 13, about 1-2 mm in the top, toe, back and heel portions and about 5 mm in the bottom portion 17. The volume of the head is preferably at least 150 $cm^3$.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A golf wood club head having a volume of at least 150 $cm^3$ comprising a top surface, a sole disposed opposite said top surface, a toe portion, a heel portion opposite said toe portion, a front impact face located between said toe and heel portions, a rear portion located opposite said face and between said toe and heel portions, said toe and rear portions forming a smooth, continuous, enlarged side surface so that (1) an upper section of said club head above the horizontal center plane, which passes through the half height of said face portion, has a volume smaller than that of a lower section of said club head below said horizontal center plane and (2) the major portion of said enlarged side surface is located below said horizontal center plane, said club head further comprising upper and lower ridges where said side surface intersects with the top surface and sole, respectively, and an intermediate ridge dividing said side surface into upper and lower portions, the upper portion being a continuous smooth surface extending from the impact face rearwardly and around the rear portion of the club head to the shaft and sloping outwardly along said toe and rear portion to meet the lower portion along the intermediate ridge.

2. A golf club head as claimed in claim 1, wherein the volume ratio of said upper section to said lower section is between 30:70 to 45:55.

* * * * *